US006443862B1

(12) United States Patent
Darnell

(10) Patent No.: US 6,443,862 B1
(45) Date of Patent: Sep. 3, 2002

(54) RETURNING FLYING POLYGON

(76) Inventor: John H. Darnell, 3948 Wistman La., Myersville, MD (US) 21773

( * ) Notice: Subject to any disclaimer, the term of this patent is extended or adjusted under 35 U.S.C. 154(b) by 0 days.

(21) Appl. No.: 09/703,242

(22) Filed: Nov. 3, 2000

Related U.S. Application Data

(60) Provisional application No. 60/163,176, filed on Nov. 3, 1999.

(51) Int. Cl.[7] ..... A63B 65/08
(52) U.S. Cl. ..... 473/590; 446/46
(58) Field of Search ..... 473/588, 589, 473/590; 446/46, 48

(56) References Cited

U.S. PATENT DOCUMENTS 4,307,656 A * 12/1981 Martin ..... 473/589
4,479,655 A * 10/1984 Adler ..... 473/589
4,946,173 A * 8/1990 Schlegel et al. ..... 473/589
5,213,539 A * 5/1993 Adler ..... 446/48

* cited by examiner

*Primary Examiner*—Steven Wong
(74) *Attorney, Agent, or Firm*—Charles N. Quinn

(57) ABSTRACT

A throwable boomerang includes an open center polygon defining a closed ring having upper and lower surfaces including from three (3) to eight (8) connected linear segments and a plurality of tabular shortened, generally rounded, rearward-projecting members extending outwardly and downwardly from said ring each along and aligned with the axis of one of said linear segments, the peripheries of said tabular member being arcuate with each segment comprising an outwardly facing airfoil having a leading edge with a continuously varying angle of attack along the segment length, with the inner trailing edge of the airfoils of all of said segments conforming to a single plane, the leading airfoil edge of each of the segments being above the vertical midpoint of the segment proximate the extending tabular member and transitioning to being below said vertical midpoint at an end of the segment which is remote from the extending tabular member.

3 Claims, 4 Drawing Sheets

RETURNING FLYING POLYGON

This application claims priority to U.S. Provisional Application No. 60/163,176, filed Nov. 3, 1999, the entirety of which is incorporated by reference herein.

SUMMARY OF THE INVENTION

This invention provides an open center polygon forming a closed ring preferably consisting of from three (3) to eight (8) linear segments with short, rounded, rearward-projecting extension members or tabs. Each linear segment preferably comprises an outwardly facing blunt edged cambered airfoil with a continuously varying angle of attack along the airfoil length and with the inner, trailing edge of the airfoil conforming to a single plane. The outer leading edge of the airfoil preferably varies in elevation above that plane except-in the tabular extensions which fall below the plane.

When thrown overhead in the manner of a conventional boomerang gripped in the right hand, tilted to the right of vertical with sufficient speed and counterclockwise spin in a light, steady breeze coming from the thrower's left, the trajectory of the open centered polygon is a nearly level and circular counterclockwise path, returning gently to the thrower along the direction of the breeze.

The returning flying polygon of the invention is an intrinsically safe version of the boomerang providing a closed ring shape, with projections from each segment being minimal, rounded and trailing projections, formed as a light weight, low impact, flexible yet stable structure. The returning flying polygon of the invention is user-friendly in that it is easier to master and safer to use than conventional boomerangs.

The aerodynamic design of the returning flying polygon overcomes instabilities which are inherent in a ring shape while minimizing drag forces thereby effortlessly yielding spectacular performance despite the light weight of the invention in the preferred embodiment.

In the preferred embodiment, the returning flying polygon is intrinsically safe having a rounded ring shape and minimal trailing protrusions. The ring shape and cambered airfoil provide intrinsically stable geometry permitting the use of thinner and lighter material, leading to low impact force in the event of a collision. This further permits safe use of the returning flying polygon in groups of people with the ring shape making the returning flying polygon easy to catch yet highly visible and providing a dramatic appearance in flight.

While a hexagonal configuration is preferable, the number of segments may vary from three (3), providing a triangular configuration, to eight (8), providing an octagonal configuration. Even higher numbers of sides are also within the scope of the invention.

DESCRIPTION OF THE PREFERRED EMBODIMENTS AND BEST MODE KNOWN FOR PRACTICING THE INVENTION

Figure 1:
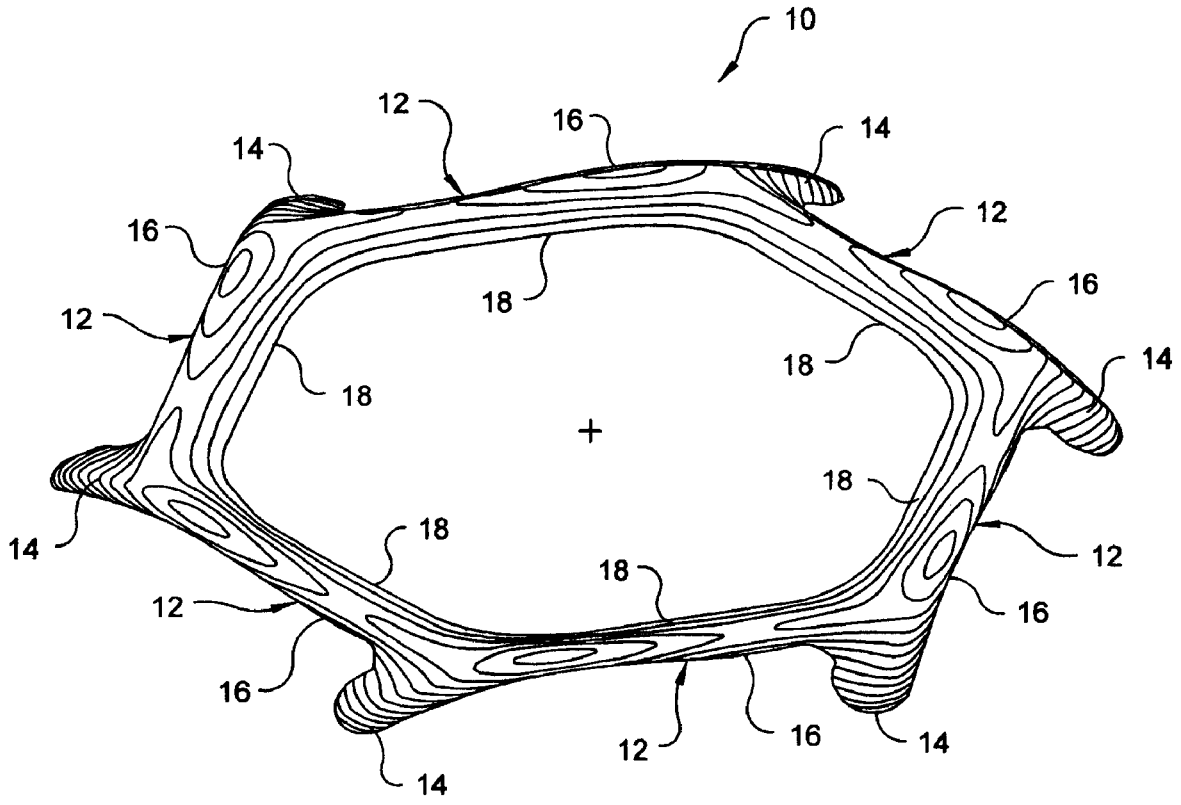
FIG. 1 is an isometric drawing of a returning flying polygon in accordance with the preferred embodiment of the invention, lined to indicate relative surface height contours on the surface of the structure.
Figure 2:
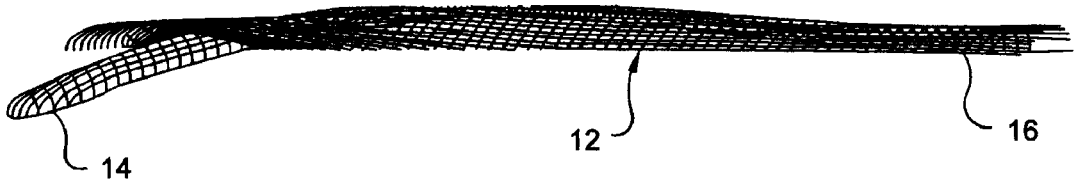
FIG. 2 is a broken elevation of a portion of the returning flying polygon illustrated in FIG. 1 where the surface has been cross-hatched to better illustrate surface contours of the returning flying polygon of the invention.

Referring to the drawings in general and to FIG. 1 in particular, a returning flying polygon in accordance with the preferred embodiment of the invention is illustrated in FIG. 1 and designated generally 10. Returning flying polygon 10 preferably includes six (6) identical segments, configured to define a generally hexagonal shape as illustrated in FIG. 1 with each segment being identified 12. Extending from each segment 12 is a first tab designated 14 which is a rearwardly projecting tab. Each segment 12 includes an airfoil leading edge 16 which is formed at the outer periphery of the hexagonal returning flying polygon 10 and an airfoil trailing edge 18 which is formed around the closed interior of returning flying polygon 10.

Figure 3:
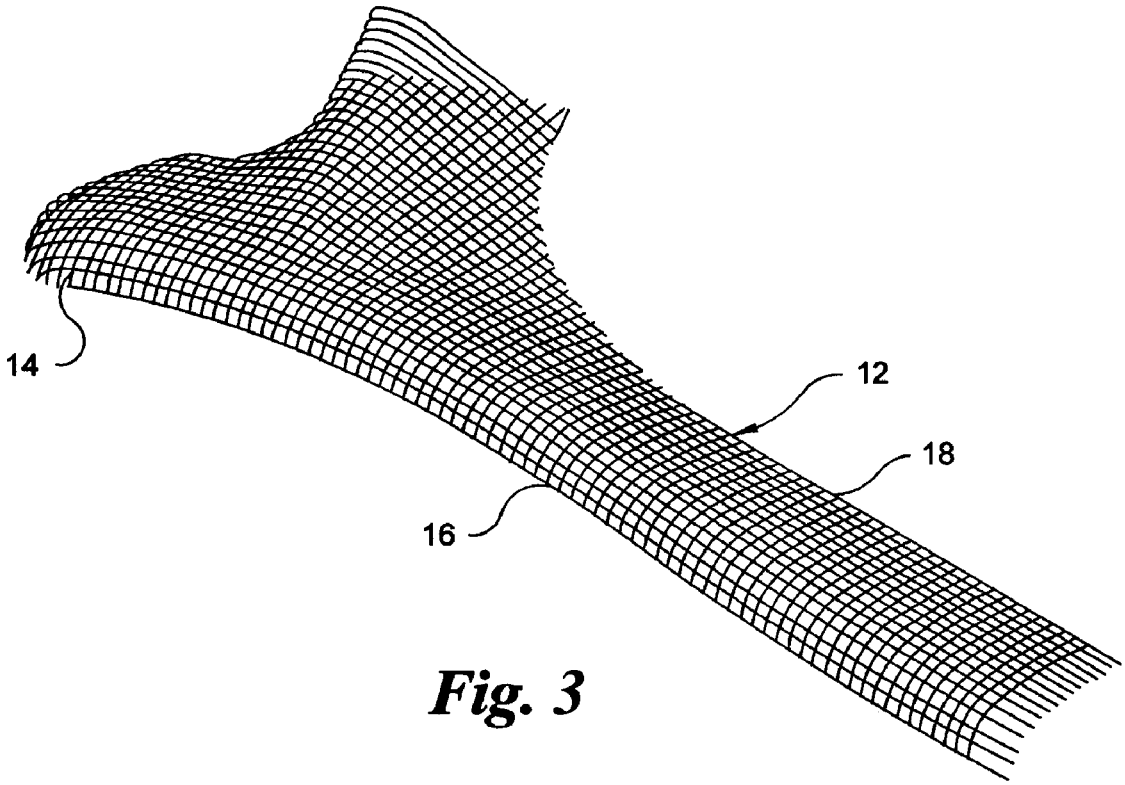
FIG. 3 is a broken isometric view of the returning flying polygon depicted in FIGS. 1 and 2 which has been cross-hatched to better illustrate surface contours.
Figure 4:
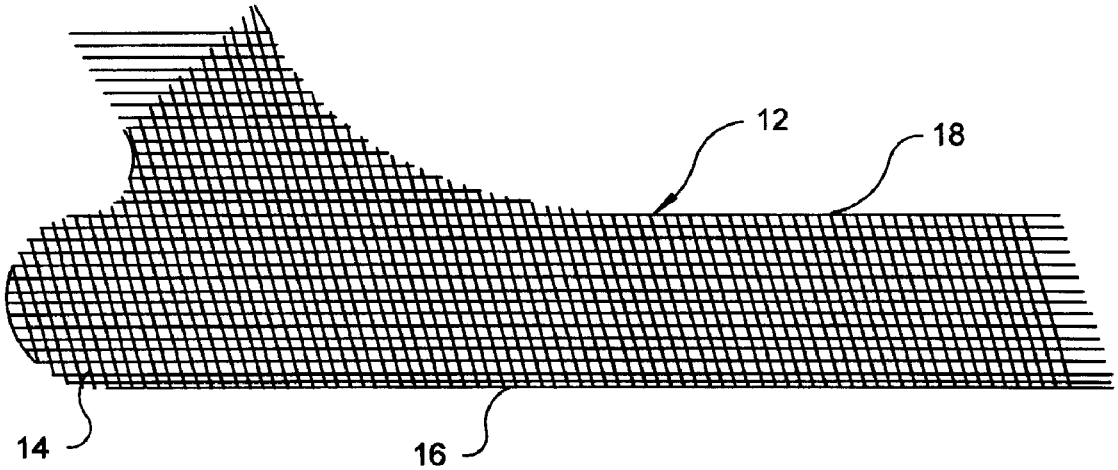
FIG. 4 is a broken top view of the structure illustrated in FIG. 3 and cross-hatched in a manner similar to FIG. 3 to illustrate surface contours.

Airfoil leading edge 16 and airfoil trailing edge 18 are illustrated particularly well in FIGS. 3 and 4.

Figure 5:
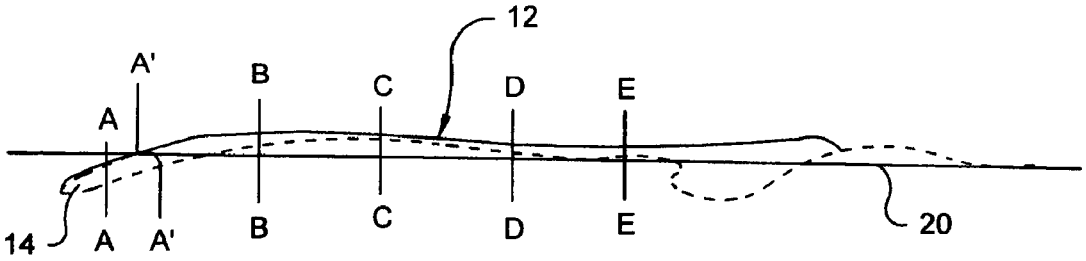
FIG. 5 is a side view of one of the six (6) sides or segments of the returning flying polygon depicted in FIG. 1.
Figure 6:
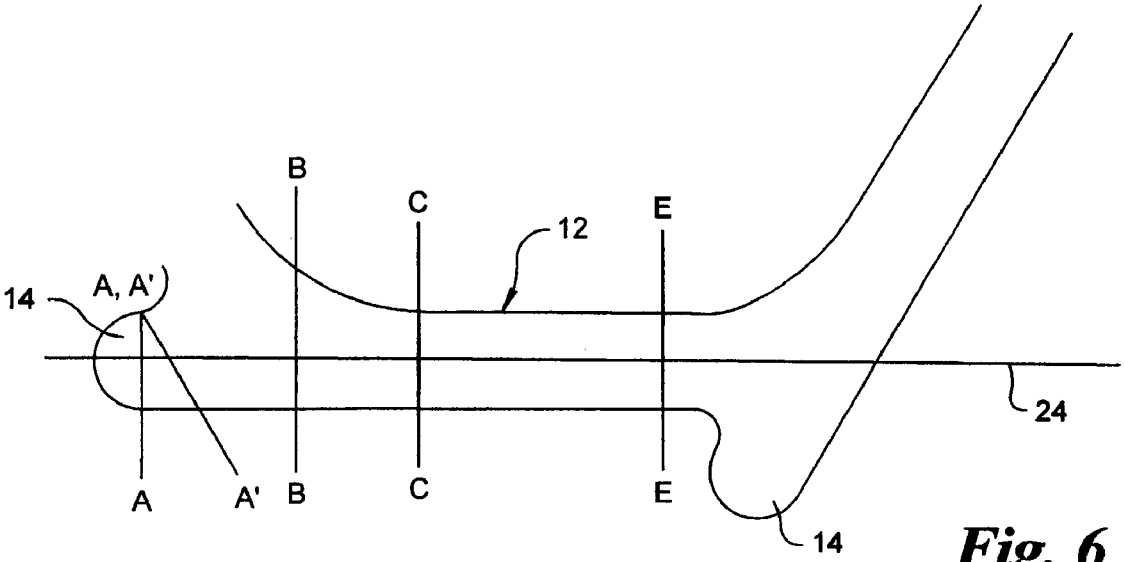
FIG. 6 is a plan view of the portion of the returning flying polygon depicted in FIG. 5.
Figure 7:
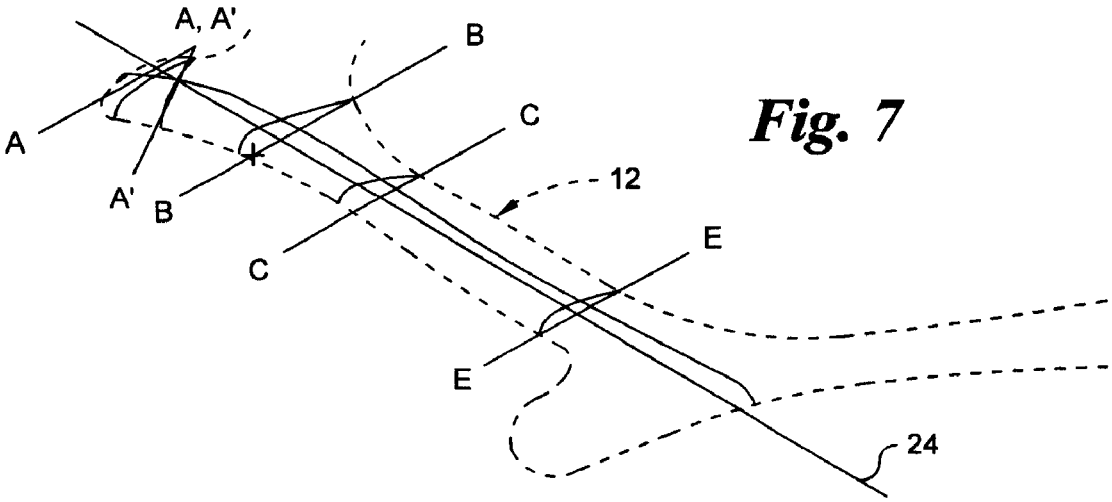
FIG. 7 is a perspective view, in dotted lines, of the portion of the returning flying polygon depicted in FIGS. 5 and 6, with solid lines depicting sectional configuration of the portions of the returning flying polygon illustrated in FIGS. 5 and 6 at corresponding alphabetically identified lines.
Figure 8:
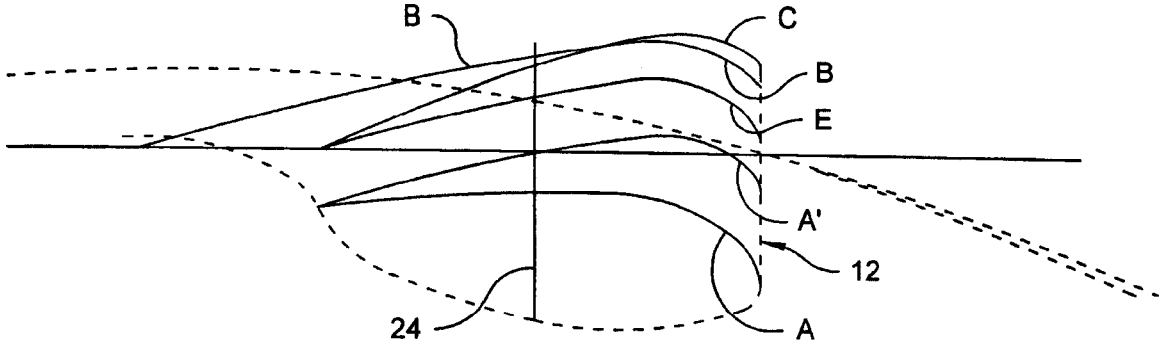
FIG. 8 is an end view illustrating the various sections depicted in FIG. 7.

FIG. 5 includes a number of lines identified by alphabetic characters A, A', B, C, D and E. These lines depict positions at which the cross-section configuration of the airfoil constituting a segment 12 is shown in FIGS. 7 and 8. Lines A—A, A'—A', B—B, C—C and E—E are also illustrated in FIG. 6. FIG. 7 depicts the cross-sectional configuration of the airfoil at the locations identified by lines A—A, A'—A', B—B, C—C and E—E where the upper edge of the airfoil configuration is depicted as a solid line extending above each one of those alphabetically identified lines.

FIG. 8 similarly illustrates the configuration of the upper surface of the airfoil at lines A—A, A'—A', B—B, C—C and E—E. Line A—A is taken perpendicularly to longitudinal axis 24 of segment 12 while line A'—A'is taken at an angle to longitudinal axis 24 of segment 12, where the angle is such that line A'—A', when inscribed on the airfoil upper surface as illustrated in FIG. 5, is perpendicular to the airfoil leading edge 16 and to the airfoil trailing edge 18 portion of first rearwardly projecting tab 14.

Figure 9:
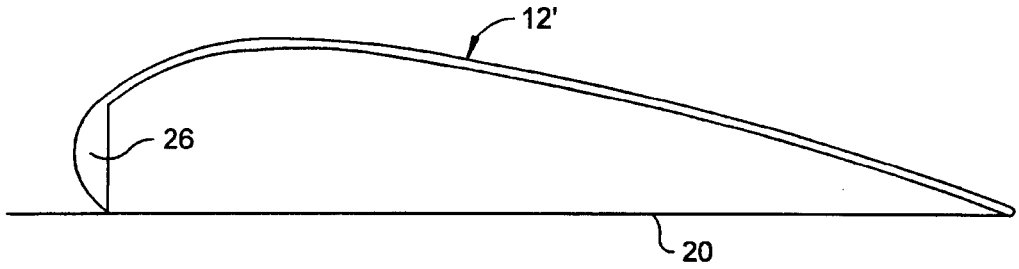
FIG. 9 is an enlarged cross-section of a returning flying polygon embodying the invention in one form in which the polygon might be mass produced.
Figure 10:
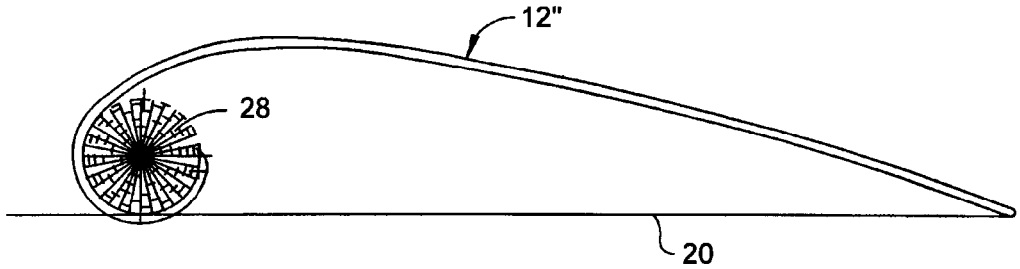
FIG. 10 is an enlarged cross-section similar to FIG. 9 of a second embodiment of the returning flying polygon showing a second form in which the polygon might be mass produced with the polygon including a ballast stem wrapped in the polygon airfoil.

FIGS. 9 and 10 illustrate preferred configurations of the returning flying polygon when manufactured for mass production. In FIG. 9, the airfoil segment 12' is weighted by a section 26 of increased thickness located at the left side in FIG. 9. In FIG. 10, the airfoil segment 12" is weighted by a ballast stem 28 which is preferably molded in place as the returning flying polygon is molded as a single injection molded piece.

I claim the following:

1. A throwable boomerang comprising:

a) an open center polygon defining a closed ring having upper and lower surfaces comprising from three (3) to eight (8) connected linear segments;

b) a plurality of tabular shortened, generally rounded, rearward-projecting members extending outwardly and downwardly from said ring each along and aligned with the axis of one of said linear segments, the peripheries of said tabular member being arcuate;

c) each segment comprising an outwardly facing airfoil having leading edge a continuously varying angle of attack along the segment length, with the inner trailing edge of the airfoils of all of said segments conforming to a single plane, the leading edge of said airfoil of each of said segments being above the vertical midpoint of said segment proximate said extending tabular member which is aligned with said segment and transitioning to being below said vertical midpoint of said segment at an end of said segment which is remote from said extending tabular member aligned with said segment thereby to present an angle of attack which varies along the length of each segment from positive to negative relative to the vertical midpoint of the segment as defined by the inner trailing edge of the airfoil segment.

2. The boomerang of claim 1 wherein each of said airfoils further comprises a section of increased thickness in the direction of the angle of attack having a vertically elongated planar rearwardly facing surface.

3. The boomerang of claim 1 wherein each of said airfoils further comprises a cylindrical weight, the axis of said cylinder being parallel with said linear segment and aligned with the leading edge of said airfoil, the rearwardly facing surface of said airfoil proximate said airfoil leading edge tangentially contacting the curved surface of said cylinder around an angle of at least 180 degrees.

* * * * *